US009291061B2

(12) United States Patent
Chouhan et al.

(10) Patent No.: US 9,291,061 B2
(45) Date of Patent: Mar. 22, 2016

(54) TURBOMACHINE BLADE TIP SHROUD WITH PARALLEL CASING CONFIGURATION

(75) Inventors: Rohit Chouhan, Bangalore (IN); Sylvain Pierre, Greer, SC (US); Gunnar Leif Siden, Greenville, SC (US); Santhosh Kumar Vijayan, Bangalore (IN); Joseph Anthony Cotroneo, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 862 days.

(21) Appl. No.: 13/447,134

(22) Filed: Apr. 13, 2012

(65) Prior Publication Data

US 2013/0272888 A1 Oct. 17, 2013

(51) Int. Cl.

| | |
|---|---|
| ***F01D 5/20*** | (2006.01) |
| ***F01D 11/08*** | (2006.01) |
| ***F01D 5/22*** | (2006.01) |

(52) U.S. Cl.

CPC ..... *F01D 5/225* (2013.01); *F01D 11/08* (2013.01); *F05D 2250/312* (2013.01)

(58) Field of Classification Search

CPC ..... F01D 5/20; F01D 11/08
USPC ..... 415/173.5
See application file for complete search history.

(56) References Cited

U.S. PATENT DOCUMENTS

| | | | | |
|---|---|---|---|---|
| 783,572 | A | 2/1905 | Gibbs | |
| 1,235,205 | A | 7/1917 | Kierstead | |
| 1,470,528 | A | 10/1923 | Flentjen | |
| 3,876,330 | A | 4/1975 | Pearson et al. | |
| 4,687,413 | A * | 8/1987 | Prario | 415/190 |
| 4,940,388 | A | 7/1990 | Lilleker et al. | |
| 5,156,525 | A * | 10/1992 | Ciokajlo | 415/199.5 |
| 5,192,185 | A * | 3/1993 | Leonard | 415/170.1 |
| 5,228,195 | A * | 7/1993 | Brown et al. | 29/888.3 |
| 5,290,144 | A * | 3/1994 | Kreitmeier | 415/173.1 |
| 5,632,598 | A * | 5/1997 | Maier | 415/173.5 |
| 5,971,710 | A * | 10/1999 | Stauffer et al. | 416/191 |

(Continued)

FOREIGN PATENT DOCUMENTS

| | | |
|---|---|---|
| CN | 1519554 A | 8/2004 |
| CN | 1987133 A | 6/2007 |

(Continued)

OTHER PUBLICATIONS

Japanese Office Action for JP Application No. 201210414726.0 mailed Jun. 30, 2015, 11 pages.

(Continued)

*Primary Examiner* — Richard Edgar
*Assistant Examiner* — Brian O Peters
(74) *Attorney, Agent, or Firm* — Fletcher Yoder, P.C.

(57) ABSTRACT

Embodiments of the present disclosure include a turbomachine having a turbomachine blade and a stationary structural component. The turbomachine blade includes a tip shroud having a leading edge portion where the leading edge portion has a first surface. The stationary structural component is disposed about the turbomachine blade and includes a corresponding portion corresponding to the leading edge portion of the tip shroud, where the corresponding portion has a second surface, where the first surface and the second surface have generally parallel contours.

18 Claims, 4 Drawing Sheets

(56) References Cited

U.S. PATENT DOCUMENTS

| | | | | |
|---|---|---|---|---|
| 6,102,655 | A * | 8/2000 | Kreitmeier | 415/173.3 |
| 6,413,045 | B1 | 7/2002 | Dancer et al. | |
| 6,508,624 | B2 * | 1/2003 | Nadeau et al. | 415/173.3 |
| 6,652,226 | B2 * | 11/2003 | Albrecht et al. | 415/173.4 |
| 6,742,783 | B1 * | 6/2004 | Lawer et al. | 277/416 |
| 6,784,597 | B1 | 8/2004 | Hess et al. | |
| 7,070,387 | B2 * | 7/2006 | Crozet et al. | 415/173.1 |
| 7,238,001 | B2 * | 7/2007 | Rushton | 415/110 |
| 7,290,982 | B2 * | 11/2007 | Girard et al. | 415/173.4 |
| 7,784,263 | B2 | 8/2010 | Ponziani | |
| 2004/0086377 | A1 * | 5/2004 | Proctor et al. | 415/116 |
| 2011/0070074 | A1 | 3/2011 | Schabowski et al. | |

FOREIGN PATENT DOCUMENTS

| | | | |
|---|---|---|---|
| CN | 102094886 | A | 6/2011 |
| EP | 2302169 | A2 | 3/2011 |
| JP | 201053745 | A | 3/2010 |

OTHER PUBLICATIONS

Chinese Office Action for CN Appiication No. 201210272337.9 mailed Jun. 30, 2015, 8 pages.

Extended European Search Report for EP Application No. 13163003.0 date Jul. 29, 2015, 7 pages.

* cited by examiner

TURBOMACHINE BLADE TIP SHROUD WITH PARALLEL CASING CONFIGURATION

BACKGROUND OF THE INVENTION

The subject matter disclosed herein relates to turbomachines, and, more particularly, a turbomachine blade tip shroud and a casing in a generally parallel configuration.

Turbomachines include compressors and turbines, such as gas turbines, steam turbines, and hydro turbines. Generally, turbomachines include a rotor, which may be a shaft or drum, to which turbomachine blades are attached. Certain turbomachine blades may include tip shrouds and/or seals to meet structural and/or performance requirements. For example, the tip shrouds and/or seals may reduce flow leakage through the cavity or passage between the turbomachine blades and a stationary structural component, such as a static shroud, surrounding the turbomachine blades and the rotor. Existing tip shroud and seal design may not adequately limit or reduce flow leakage between the turbomachine blades and the stationary structural component surrounding the turbomachine blades and the rotor, which may result in a reduction in turbomachine efficiency. Similarly, existing stationary structural component design may not adequately limit or reduce flow leakage between the turbomachine blades and the stationary structural component surrounding the turbomachine blades and the rotor.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a turbomachine includes a turbomachine blade and a stationary structural component. The turbomachine blade includes a tip shroud having a leading edge portion where the leading edge portion has a first surface. The stationary structural component is disposed about the turbomachine blade and includes a corresponding portion corresponding to the leading edge portion of the tip shroud, where the corresponding portion has a second surface, where the first surface and the second surface have generally parallel contours.

In a second embodiment, a system comprises a turbine having a turbine blade. The turbine blade includes a tip shroud having a first surface. The turbine further includes a stationary structural component disposed about the turbine blade, where the stationary structural component has a second surface disposed about the first surface of the tip shroud, where the first surface and the second surface have generally parallel contours.

In a third embodiment, a turbine includes a turbine blade and a stationary structural component. The turbine blade includes a tip shroud having a first surface, where the first surface has a leading edge surface of a leading edge overhang extending in an upstream direction from a leading edge of the turbine blade, a nose portion, and an upstream surface of a rail of a labyrinth seal of the tip shroud, where the leading edge surface of the leading edge overhang is adjacent the nose portion, and the nose portion is adjacent the upstream surface of the rail. The structural component is disposed about the turbine blade, where the stationary structural component includes a second surface, where the second surface has a first corresponding portion disposed generally opposite the leading edge surface of the leading edge overhang, a second corresponding portion disposed generally opposite the nose portion, and a third corresponding portion disposed generally opposite the upstream surface of the rail, where the first corresponding portion is adjacent the second corresponding portion and the second corresponding portion is adjacent the third corresponding portion, and where the first corresponding portion and the leading edge surface of the leading edge overhang have generally parallel contours, the second corresponding portion and the nose portion have generally parallel contours, and the third corresponding portion and the upstream surface of the rail have generally parallel contours.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
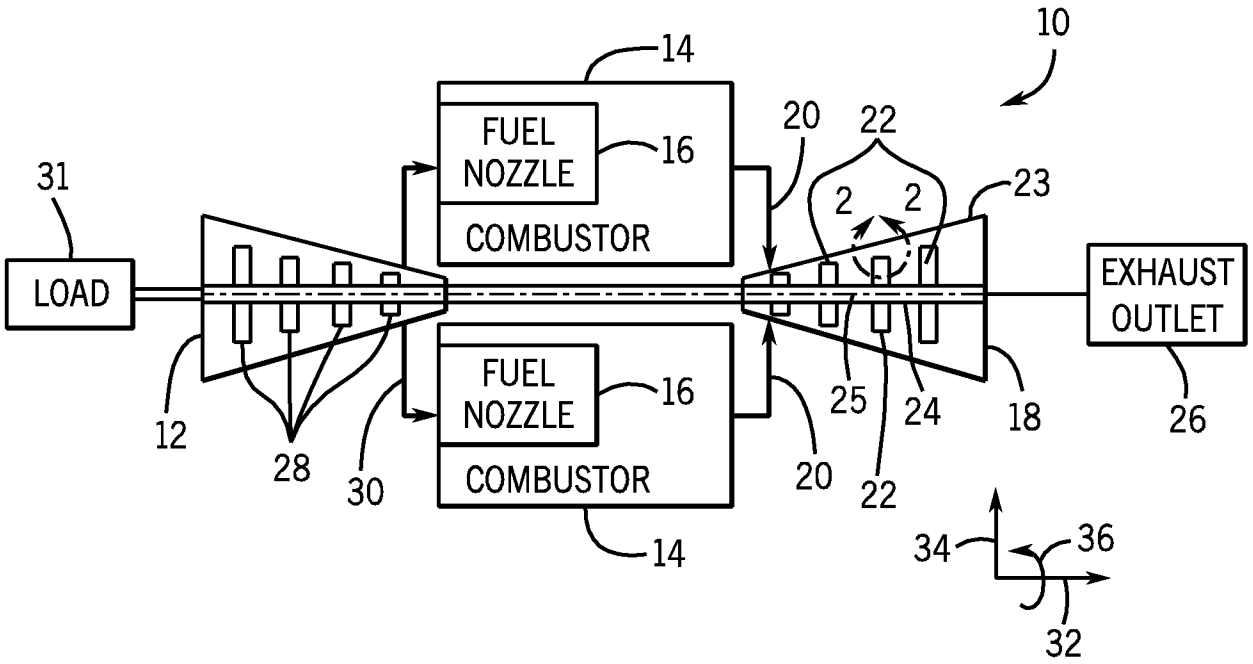
FIG. 1 is a schematic block diagram of an embodiment of a turbine engine system.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments include a turbomachine blade tip shroud and a turbomachine stationary structural component, where a leading edge portion of the turbomachine blade tip shroud and a corresponding portion of the turbomachine stationary structural component have a generally parallel configuration. As discussed in detail below, the generally parallel configuration between the leading edge portion of the turbomachine blade tip shroud and the corresponding portion of the turbomachine stationary structural component may provide a more tailored clearance between the turbomachine blade tip shroud and the turbomachine stationary structural component. This may reduce the leakage of flow escaping through the clearance or cavity between the turbomachine blade tip shroud and the turbomachine stationary structural component. Additionally, the more tailored clearance may also reduce the mixing and/or flow churning loss in the clearance or cavity. As a result, a turbomachine having blades with the described turbomachine blade tip shroud and stationary structural component may experience improved performance and efficiency. While the disclosed generally parallel configuration between the turbomachine blade tip shroud and the turbomachine stationary structural component may be utilized with turbomachine blades of a variety of turbomachines (e.g., turbines and compressors), the following discussion describes a generally parallel configuration between blade tip shrouds and a stationary structural component in the context of a turbine, such as a gas turbine or a steam turbine. However, it is important to note that the following discussion is not intended to limit the application of the generally parallel configuration to turbines. Additionally, as used herein, the term "generally parallel" refers to surfaces which are designed to be parallel with one another. However, it will be appreciated that the described generally parallel surfaces may not be exactly parallel due to manufacturing tolerances, operating conditions (e.g., vibrations, thermal expansion), and so forth. Thus, "generally parallel" may also refer to surfaces that, while designed to be parallel, are not exactly or precisely parallel. Similarly, "generally perpendicular" surfaces may refer to surfaces that, while designed to be perpendicular, are not exactly or precisely perpendicular due to manufacturing tolerances, operating conditions (e.g., vibrations, thermal expansion), and so forth.

Turning now to the drawings, FIG. 1 illustrates a block diagram of an embodiment of a gas turbine system 10 having a turbine 18 with turbine blades 22 and a stationary structural component 23, where the stationary structural component 23 and tip shrouds of the turbine blades 22 have a parallel configuration relative to one another. The system 10 includes a compressor 12, combustors 14 having fuel nozzles 16, and the turbine 18. The fuel nozzles 16 route a liquid fuel and/or gas fuel, such as natural gas or syngas, into the combustors 14. The combustors 14 ignite and combust a fuel-air mixture, and then pass hot pressurized combustion gases 20 (e.g., exhaust) into the turbine 18. The turbine 18 includes the stationary structural component 23, which generally surrounds and/or encloses the turbine blades 22 and a rotor 24 of the turbine 18. In certain embodiments, the stationary structural component 23 may be a housing, casing, shroud, and so forth. The turbine blades 22 are coupled to the rotor 24, which is also coupled to several other components throughout the turbine system 10, as illustrated. As the combustion gases 20 pass through the turbine blades 22 in the turbine 18, the turbine 18 is driven into rotation, which causes the rotor 24 to rotate along a rotational axis 25. Eventually, the combustion gases 20 exit the turbine 18 via an exhaust outlet 26.

In the illustrated embodiment, the compressor 12 includes compressor blades 28. The compressor blades 28 within the compressor 12 are coupled to the rotor 24, and rotate as the rotor 24 is driven into rotation by the turbine 18, as discussed above. As the compressor blades 28 rotate within the compressor 12, the compressor blades 28 compress air from an air intake into pressurized air 30, which is routed to the combustors 14, the fuel nozzles 16, and other portions of the gas turbine system 10. The fuel nozzles 14 then mix the pressurized air and fuel to produce a suitable fuel-air mixture, which combusts in the combustors 14 to generate the combustion gases 20 to drive the turbine 18. Further, the rotor 24 may be coupled to a load 31, which may be powered via rotation of the rotor 24. For example, the load 31 may be any suitable device that may generate power via the rotational output of the gas turbine system 10, such as a power generation plant or an external mechanical load. For instance, the load 31 may include an electrical generator, a propeller of an airplane, and so forth. In the following discussion, reference may be made to various directions, such as an axial direction or axis 32, a radial direction or axis 34, and a circumferential direction or axis 36 of the turbine 18.

Figure 2:
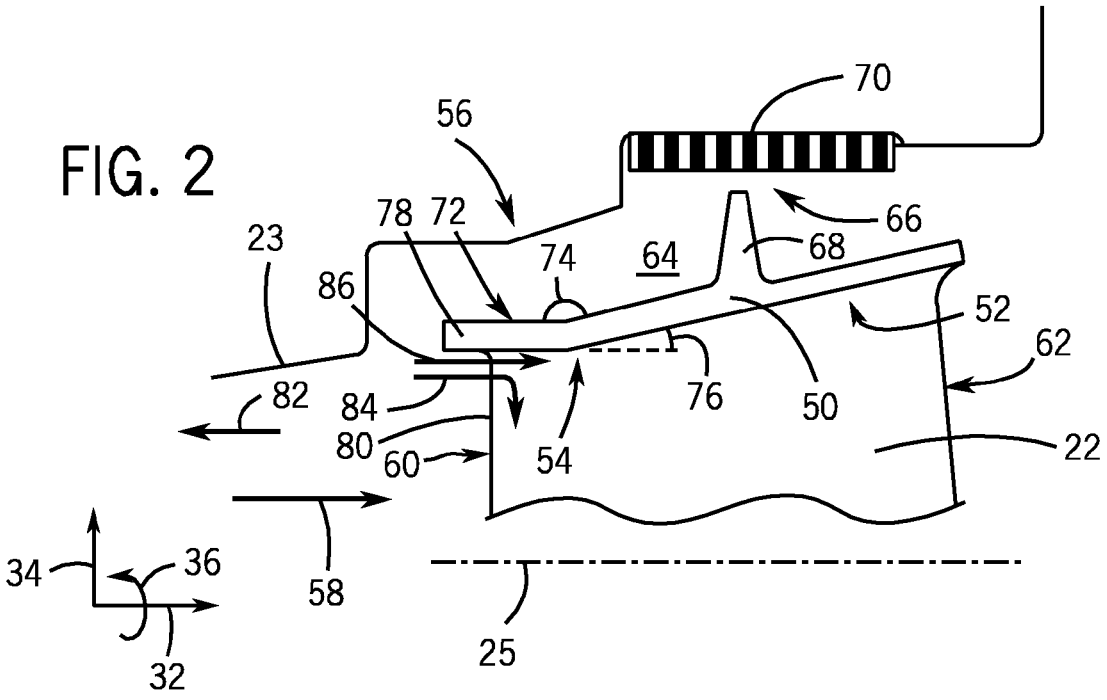
FIG. 2 is a partial side view of a turbomachine blade, illustrating an embodiment of a tip shroud and turbomachine stationary structural component having a generally parallel configuration, in accordance with embodiments of the present disclosure.

FIG. 2 is a partial side view of an embodiment of the turbine blade 22 and the stationary structural component 23. More specifically, the illustrated embodiment of the turbine blade 22 includes a tip shroud 50 disposed on an outer radial end 52 of the turbine blade 22, where a leading edge portion 54 (e.g., surface) of the tip shroud 50 and a corresponding portion 56 (e.g., surface) of the stationary structural component 23 have a generally parallel configuration. In other words, the corresponding portion 56 of the stationary structural component 23 is generally contoured to be parallel with the leading edge portion 54 of the tip shroud 50. For example, the slopes of the leading edge portion 54 of the tip shroud 50 may be generally similar to the slopes of the corresponding portion 56 of the stationary structural component 23.

As mentioned above, the tip shroud 50 is disposed at the outer radial end 52 of the turbine blade 22. As will be appreciated, the tip shroud 50 may serve to block flow leakage between the outer radial end 52 of the turbine blade 22 and the stationary structural component 23. In other words, the tip shroud 50 may help block a fluid flow 58 (e.g., a flow of the combustion gases 20 from the combustor 14 of FIG. 1) within the turbine 18 from passing from a leading edge 60 to a trailing edge 62 of the turbine blade 22 through a clearance (e.g., a cavity) 64 between the outer radial end 52 of the turbine blade 22 and the stationary structural component 23. In certain embodiments, the tip shroud 50 may also include a labyrinth seal 66, which further blocks the fluid flow 58 from passing from the leading edge 60 to the trailing edge 62 through the clearance 64. In the illustrated embodiment, the labyrinth seal 66 includes a single rail 68, which extends in the radial direction 34 towards a honeycomb insert 70 (e.g., a casing abradable surface) disposed on the stationary structural component 23. In other embodiments, such as the embodiments illustrated in FIGS. 4-6, the labyrinth seal 66 may include multiple rails 68 and honeycomb inserts 70 (e.g., casing abradable surfaces). In the following discussion, the leading edge portion 54 of the tip shroud 50 refers to the portion of the tip shroud 50 upstream of the rail 68. However, in other embodiments, the leading edge portion 54 may refer to a section of the tip shroud 50 including portions downstream of the rail 68.

In the illustrated embodiment, the tip shroud 50 includes a nose portion 72. As shown, the nose portion 72 of the tip shroud 50 and the remaining portion of the tip shroud 50 (i.e., the portion of the tip shroud 50 not including the nose portion 72) are not collinear. In other words, the nose portion 72 of the tip shroud 50 and the remaining portion of the tip shroud 50 form an angle 74, which may be less than 180 degrees. For example, the angle 74 between the nose portion 72 of the tip shroud 50 and the remaining portion of the tip shroud 50 may be approximately 1 to 180, 2 to 160, 3 to 140, 4 to 120, 5 to 100, 6 to 80, 7 to 60, or 8 to 40 degrees. In the illustrated embodiment, the nose portion 72 of the tip shroud 50 is generally parallel with the rotational axis 25 of the turbine 18, and the remaining portion of the tip shroud 50 is generally oriented at an angle 76 to the rotational axis 25 of the turbine 18. For example, the angle 76 between the remaining portion of the tip shroud 50 and the rotational axis 25 of the turbine 18 may be approximately 0 to 75, 5 to 60, 10 to 45, or 15 to 30 degrees. As discussed in detail below, in other embodiments, the nose portion 72 of the tip shroud 50 and the remaining portion of the tip shroud 50 may be collinear. For example, the nose portion 72 of the tip shroud 50 and the remaining portion of the tip shroud 50 may be collinear and may form a substantially constant angle with the rotational axis 25 of the turbine 18 (see, e.g., FIG. 6). Additionally, the nose portion 72 of the tip shroud and the remaining portion of the tip shroud 50 may be collinear and may be generally parallel with the rotational axis 25 of the turbine 18.

Additionally, as shown, the nose portion 72 of the tip shroud 50 includes a leading edge overhang 78. More specifically, the leading edge overhang 78 of the nose portion 72 of the tip shroud 50 extends over a leading edge 80 of the turbine blade 22 in an upstream axial direction 82. In this manner, the tip shroud 50 may further block the fluid flow 58 from passing from the leading edge 60 to the trailing edge 62 of the turbine blade 22 through the clearance 64 between the outer radial end 52 of the turbine blade 22 and the stationary structural component 23. For example, the leading edge overhang 78 may direct the fluid flow 58 down the turbine blade 22 generally in the radial direction 34, as indicated by arrow 84, or across the turbine blade 22 in the axial direction 32, as indicated by arrow 86.

Figure 3:
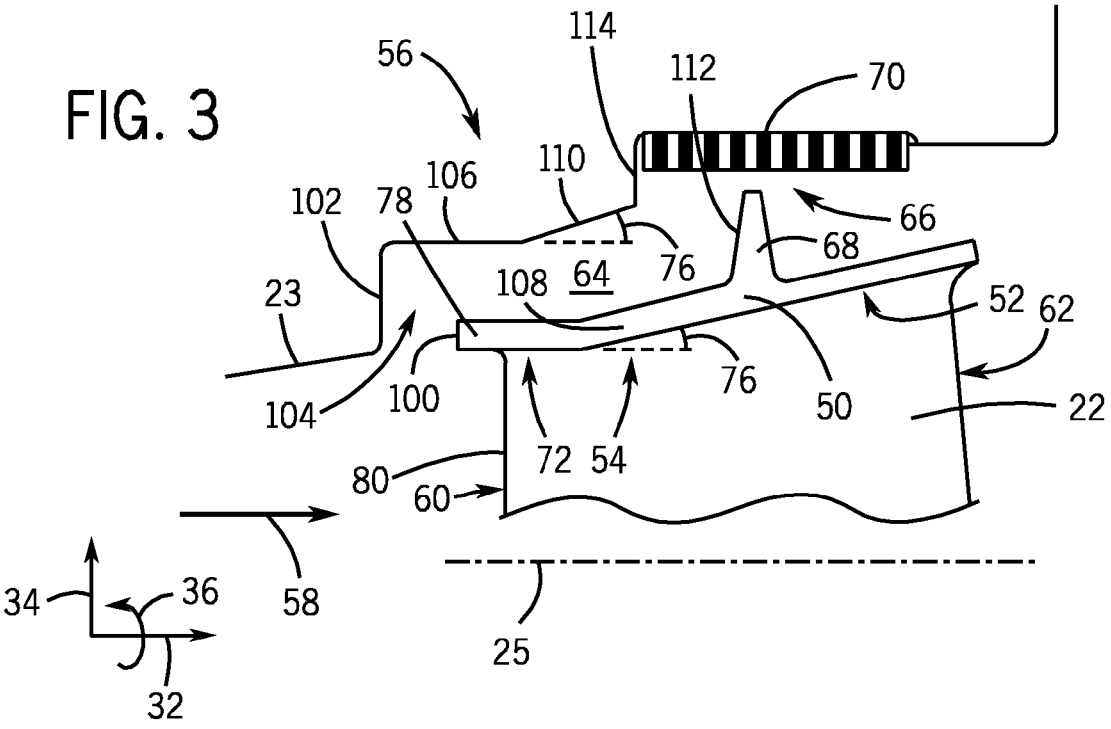
FIG. 3 is a partial side view of a turbomachine blade, illustrating an embodiment of a tip shroud and turbomachine stationary structural component having a generally parallel configuration, in accordance with embodiments of the present disclosure.

FIG. 3 is a partial side view of the embodiment of the turbine blade 22 and the stationary structural component 23 shown in FIG. 2, illustrating the tip shroud 50 disposed on the outer radial end 52 of the turbine blade 22, where the leading edge portion 54 of the tip shroud 50 and the corresponding portion 56 of the stationary structural component 23 have a generally parallel configuration. In other words, the corresponding portion 56 of the stationary structural component 23 is generally contoured to be parallel with the leading edge portion 54 of the tip shroud 50. In this manner, the clearance 64 between the tip shroud 50 and the stationary structural component 23 may be more tailored. As a result, the fluid flow 58 within the turbine 18 may be further reduced from passing from the leading edge 60 to the trailing edge 62 of the turbine blade 22 through the clearance 64 between the outer radial end 52 of the turbine blade 22 and the stationary structural component 23.

As mentioned above, the leading edge portion 54 of the tip shroud 50 and the corresponding portion 56 of the stationary structural component 23 have a generally parallel configuration. For example, in the illustrated embodiment, a leading edge 100 of the leading edge overhang 78 corresponds with a first corresponding portion 102 of the stationary structural component 23. As shown, the leading edge 100 of the leading edge overhang 78 and the first corresponding portion 102 each have a generally vertical orientation. In other words, the leading edge 100 of the leading edge overhang 78 and the first corresponding portion 102 each extend generally in the radial direction 34. Additionally, the first corresponding portion 102 of the stationary structural component 23 is disposed generally upstream from the leading edge 100 of the leading edge overhang 78, thereby creating an opening 104 of the clearance 64 between the tip shroud 50 and the stationary structural component 23.

The nose portion 72 of the tip shroud 50 corresponds with a second corresponding portion 106 of the stationary structural component 23. As previously discussed, the nose portion 72 of the tip shroud 50 is generally parallel with the rotational axis 25 of the turbine 18. Additionally, the second corresponding portion 106 of the stationary structural component 23 is generally parallel with the rotational axis 25 of the turbine 18. Furthermore, as similarly discussed above, the second corresponding portion 106 of the stationary structural component 23 is disposed generally upstream from the nose portion 72 of the tip shroud 50. Additionally, the nose portion 72 of the tip shroud 50 and the second corresponding portion 106 of the stationary structural component 23 are disposed generally opposite one another across the clearance 64 between the tip shroud 50 and the stationary structural component 23, thereby creating a generally parallel configuration between the nose portion 72 of the tip shroud 50 and the second corresponding portion 106 of the stationary structural component 23.

As discussed above, the remaining portion of the tip shroud 50 (i.e., the portion of the tip shroud 50 not including the nose portion 72) is generally disposed at the angle 76 relative to the rotational axis 25 of the turbine blade 18. For example, an intermediate portion 108 (i.e., the portion of the tip shroud 50 between the nose portion 72 of the tip shroud 50 and the rail 68 of the labyrinth seal 66) is generally oriented at the angle 76. The intermediate portion 108 of the tip shroud 50 corresponds to a third corresponding portion 110 of the stationary structural component 23, which also is generally oriented at the angle 76 relative to the rotational axis 25 of the turbine 18. Moreover, as similarly discussed above, the third corresponding portion 110 of the stationary structural component 23 is disposed generally upstream from the intermediate portion 108 of the tip shroud 50. In this manner, the intermediate portion 108 of the tip shroud 50 and the third corresponding portion 110 of the stationary structural component 23 are disposed generally opposite one another across the clearance 64 between the tip shroud 50 and the stationary structural component 23. Additionally, the intermediate portion 108 of the tip shroud 50 and the third corresponding portion 110 of the stationary structural component 23 are generally arranged in a parallel configuration. In other words, the contours of the intermediate portion 108 of the tip shroud 50 and the third corresponding portion 110 of the stationary structural component 23 are generally parallel with one another.

Furthermore, as mentioned above, the tip shroud 50 includes the rail 68 of the labyrinth seal 66, which generally extends in the radial direction 34. As shown, the rail 66 has an upstream surface 112, which is generally vertical. In other words, the upstream surface 112 of the rail 66 extends generally in the radial direction 34. In the illustrated embodiment, the upstream surface 112 of the rail 66 corresponds to a fourth corresponding portion 114 of the stationary structural component 23. The fourth corresponding portion 114 also extends generally in the radial direction 34 (i.e., the fourth corresponding portion 114 is generally vertical). Additionally, as similarly discussed above, the fourth corresponding portion 114 of the stationary structural component 23 is disposed generally upstream from the upstream surface 112 of the rail 68 of the labyrinth seal 66, and the upstream surface 112 of the rail 68 and the fourth corresponding portion 114 of the stationary structural component 23 are disposed opposite one another across the clearance 64. In this manner, the upstream surface 112 of the rail 68 and the fourth corresponding portion 114 of the stationary structural component 23 are arranged in a generally parallel configuration relative to one another.

As shown, the leading edge 100 of the leading edge overhang 78, the nose portion 72 of the tip shroud 50, the intermediate portion 108 of the tip shroud 50, and the upstream surface 112 of the rail 68 are arranged adjacent to one another and in consecutive order along the tip shroud 50 in the axial direction 32, with the leading edge 100 of the leading edge overhang 78 being the most upstream. Similarly, the portions of the stationary structural component 23 corresponding to each of the above-mentioned portions of the tip shroud 50 are arranged adjacent to one another and in consecutive order. Specifically, the first corresponding portion 102 of the stationary structural component 23, the second corresponding portion 106 of the stationary structural component 23, the third corresponding portion 110 of the stationary structural component 23, and the fourth corresponding portion 114 of the stationary structural component 23 are arranged in consecutive order along the stationary structural component 23 in the axial direction 32 and the radial direction 34, with the first corresponding portion 102 of the stationary structural component 23 being the most upstream.

As described above, each portion of the leading edge portion 54 of the tip shroud 50 (e.g., the leading edge 100, nose portion 72, etc.) and the portion of the stationary structural component 23 with which it corresponds (e.g., the first corresponding portion 102, the second corresponding portion 106, etc.) have similar (e.g., generally parallel) contours and are disposed opposite one another across the clearance 64 between the tip shroud 50 and the stationary structural component 23. In certain embodiments, each portion of the leading edge portion 54 of the tip shroud 50 and the portion of the stationary structural component 23 with which it corresponds may be offset in the axial direction 32 the same or similar distance as every other portion of the leading edge portion 54 and the portion of the stationary structural component 23 with which they correspond. In this manner, the leading edge portion 54 of the tip shroud 50 and the corresponding portion 56 of the stationary structural component 23 are arranged in a generally parallel configuration. The generally parallel configuration of the leading edge portion 54 of the tip shroud 50 and the corresponding portion 56 of the stationary structural component 23 may help reduce leakage of the fluid flow 58 through the clearance 64 between the tip shroud 50 and the stationary structural component 23. Additionally, the generally parallel configuration may help reduce the generation of vortex flows within the clearance 64. For example, the generally parallel configuration between the leading edge portion 54 of the tip shroud 50 and the corresponding portion 56 of the stationary structural component 23 may provide a more tailored and/or reduced clearance 64 between the tip shroud 50 and the stationary structural component 23, resulting in increased blockage of the fluid flow 58 through the clearance 64.

Figure 4:
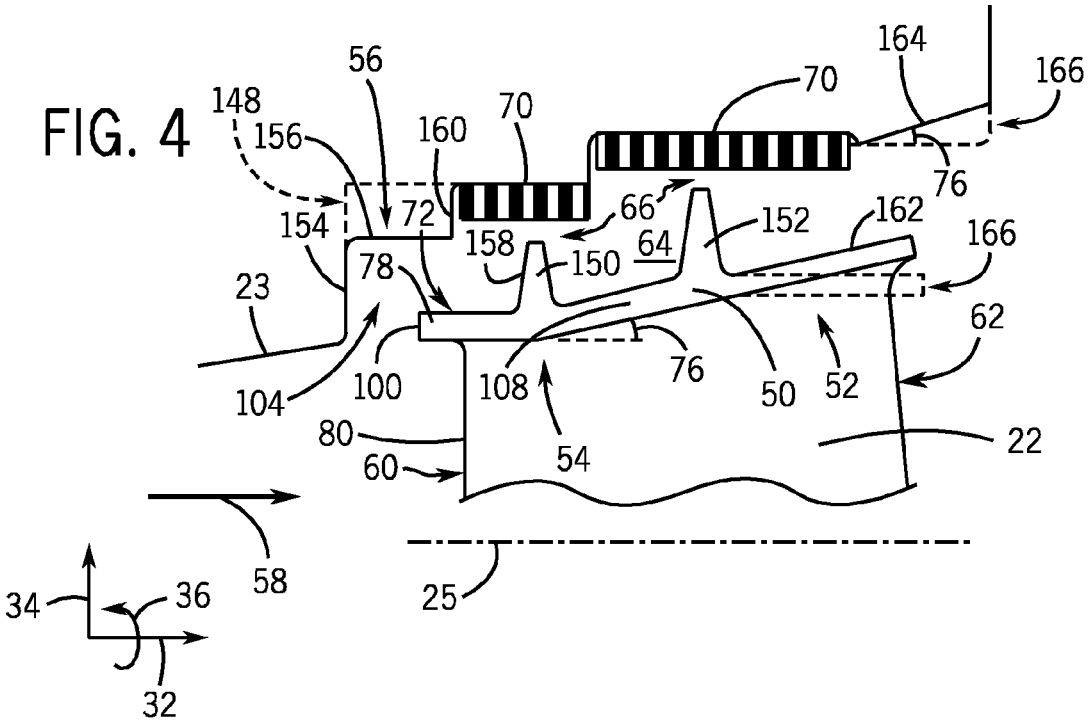
FIG. 4 is a partial side view of a turbomachine blade, illustrating an embodiment of a tip shroud and turbomachine stationary structural component having a generally parallel configuration, in accordance with embodiments of the present disclosure.

FIG. 4 is a partial side view of an embodiment of the turbine blade 22 and the stationary structural component 23, illustrating the tip shroud 50 disposed on the outer radial end 52 of the turbine blade 22, where the tip shroud 50 includes the labyrinth seal 66 having two rails 68 (e.g., a first rail 150 and a second rail 152) and two honeycomb inserts 70 (e.g., casing abradable surfaces). Additionally, the leading edge portion 54 of the tip shroud 50 and the corresponding portion 56 of the stationary structural component 23 have a generally parallel configuration. For example, the corresponding portion 56 of the stationary structural component 23 having a generally parallel configuration with the leading edge portion 54 of the tip shroud 50 may be contrasted with a corresponding portion 148 of the stationary structural component 23, which may not be generally parallel to the leading edge portion 54 of the tip shroud 50 For example, the As shown, the intermediate portion 108 of the tip shroud 50 extends between the first rail 150 and the second rail 152. In the illustrated embodiment, the leading edge portion 54 of the tip shroud 50 generally refers to the portion of the tip shroud 50 upstream of the first rail 150 of the labyrinth seal 66.

In the illustrated embodiment, the leading edge 100 of the leading edge overhang 78 corresponds with a first corresponding portion 154 of the stationary structural component 23. In other words, the leading edge 100 of the leading edge overhang 78 and the first corresponding portion 154 each extend generally in the radial direction 34. Additionally, the first corresponding portion 154 of the stationary structural component 23 is disposed generally upstream from the leading edge 100 of the leading edge overhang 78, thereby creating the opening 104 of the clearance 64 between the tip shroud 50 and the stationary structural component 23.

The nose portion 72 of the tip shroud 50 corresponds with a second corresponding portion 156 of the stationary structural component 23. In the illustrated embodiment, the nose portion 72 of the tip shroud 50 is generally parallel with the rotational axis 25 of the turbine 18. Additionally, the second corresponding portion 156 of the stationary structural component 23 is generally parallel with the rotational axis 25 of the turbine 18. Furthermore, as similarly discussed above, the second corresponding portion 156 of the stationary structural component 23 is disposed generally upstream from the nose portion 72 of the tip shroud 50. Additionally, the nose portion 72 of the tip shroud 50 and the second corresponding portion 156 of the stationary structural component 23 are disposed generally opposite one another across the clearance 64 between the tip shroud 50 and the stationary structural component 23, thereby creating a generally parallel configuration between the nose portion 72 of the tip shroud 50 and the second corresponding portion 156 of the stationary structural component 23.

In the illustrated embodiment, the tip shroud 50 includes the first rail 150 of the labyrinth seal 66, which generally extends in the radial direction 34. As shown, the first rail 150 has an upstream surface 158, which is generally vertical. In other words, the upstream surface 158 of the first rail 150 extends generally in the radial direction 34. The upstream surface 158 of the first rail 150 corresponds to a third corresponding portion 160 of the stationary structural component 23. The third corresponding portion 160 also extends generally in the radial direction 34 (i.e., the third corresponding portion 160 is generally vertical). Additionally, as similarly discussed above, the third corresponding portion 160 of the stationary structural component 23 is disposed generally upstream from the upstream surface 158 of the first rail 150 of the labyrinth seal 66. In this manner, the upstream surface 158 of the rail 150 and the third corresponding portion 160 of the stationary structural component are arranged in a generally parallel configuration relative to one another.

Furthermore, in certain embodiments, a trailing edge portion 162 of the tip shroud 50 and the corresponding portion 56 of the stationary structural component 23 may have a parallel configured. For example, the trailing edge portion 162 (e.g., a portion of the tip shroud 50 aft or downstream of the second rail 152) and a corresponding portion 164 the stationary structural component 23 may have a parallel configuration. In the illustrated embodiment, the trailing edge portion 162 of the tip shroud 50 and the corresponding portion 164 of the stationary structural component 23 have a conical configuration. In other words, the trailing edge portion 162 and the corresponding portion 164 have a slope approximately at the angle 76 relative to the rotational axis 25 of the turbine 18. In other embodiments, the trailing edge portion 162 of the tip shroud 50 and the corresponding portion 164 of the stationary structural component 23 may have a cylindrical configuration, as indicated by reference numeral 166. That is, the trailing edge portion 162 of the tip shroud 50 and the corresponding portion 164 of the stationary structural component 23 may be generally parallel to the rotational axis 25 of the turbine 18.

As shown, the leading edge 100 of the leading edge overhang 78, the nose portion 72 of the tip shroud 50, and the upstream surface 158 of the first rail 150 are arranged adjacent to one another and in consecutive order along the tip shroud 50 in the axial direction 32, with the leading edge 100 of the leading edge overhang 78 being the most upstream. Similarly, the portions of the stationary structural component 23 corresponding to each of the above-mentioned portions of the tip shroud 50 are arranged adjacent to one another and in consecutive order. Specifically, the first corresponding portion 154 of the stationary structural component 23, the second corresponding portion 156 of the stationary structural component 23, and the third corresponding portion 160 of the stationary structural component 23 are arranged in consecutive order along the stationary structural component 23 in the axial direction 32, with the first corresponding portion 154 of the stationary structural component 23 being the most upstream.

As described above, each portion of the leading edge portion 54 of the tip shroud 50 (e.g., the leading edge 100, nose portion 72, etc.) and the portion of the stationary structural component 23 with which it corresponds (e.g., the first corresponding portion 154, the second corresponding portion 156, etc.) have similar (e.g., generally parallel) contours and are disposed opposite one another across the clearance 64 between the tip shroud 50 and the stationary structural component 23. In certain embodiments, each portion of the leading edge portion 54 of the tip shroud 50 and the portion of the stationary structural component 23 with which it corresponds may be offset in the axial direction 32 the same or similar distance as every other portion of the leading edge portion 54 and the portion of the stationary structural component 23 with which they correspond. In this manner, the leading edge portion 54 of the tip shroud 50 and the corresponding portion 56 of the stationary structural component 23 are arranged in a generally parallel configuration. The generally parallel configuration of the leading edge portion 54 of the tip shroud 50 and the corresponding portion 56 of the stationary structural component 23 may help reduce leakage of the fluid flow 58 through the clearance 64 between the tip shroud 50 and the stationary structural component 23. For example, the generally parallel configuration between the leading edge portion 54 of the tip shroud 50 and the corresponding portion 56 of the stationary structural component 23 may provide a more tailored and/or reduced clearance 64 between the tip shroud 50 and the stationary structural component 23, resulting in reduction of leakage of the fluid flow 58 through the clearance 64.

Figure 5:
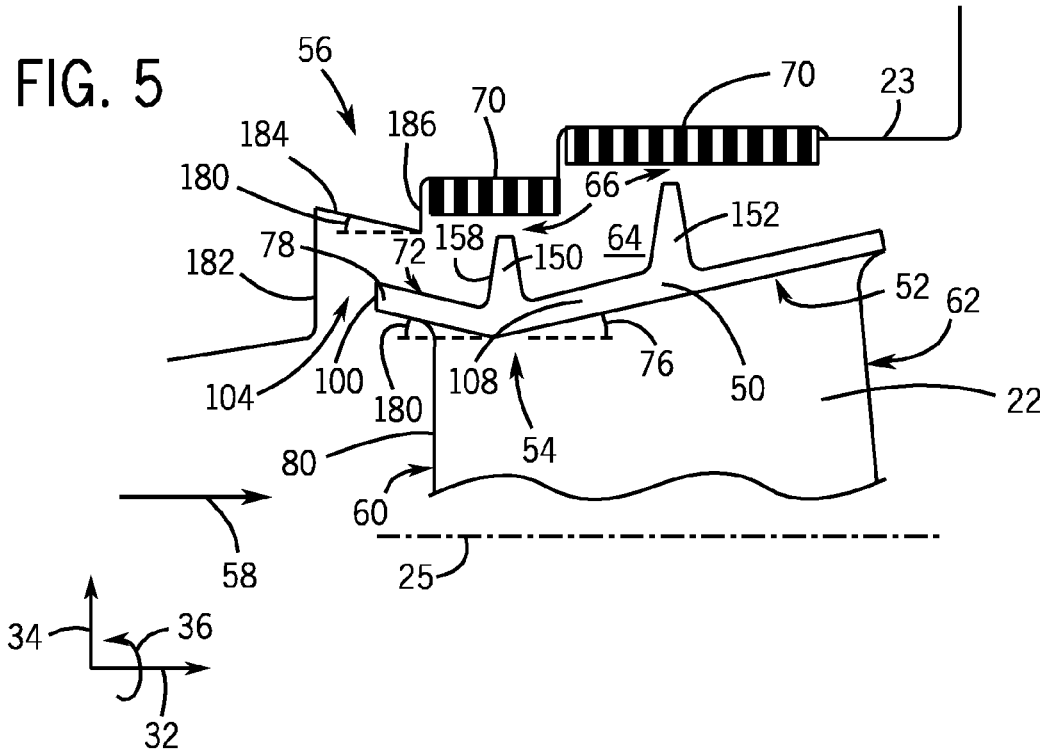
FIG. 5 is a partial side view of a turbomachine blade, illustrating an embodiment of a tip shroud and turbomachine stationary structural component having a generally parallel configuration, in accordance with embodiments of the present disclosure.

FIG. 5 is a partial side view of an embodiment of the turbine blade 22 and the stationary structural component 23, illustrating the tip shroud 50 disposed on the outer radial end 52 of the turbine blade 22, where the tip shroud 50 includes the labyrinth seal 66 having two rails 68 (e.g., the first rail 150 and the second rail 152) and two honeycomb inserts 70 (e.g., casing abradable surfaces), and the leading edge portion 54 of the tip shroud 50 and the corresponding portion 56 of the stationary structural component 23 have a generally parallel configuration. Additionally, in the illustrated embodiment, the nose portion 72 of the tip shroud 50 is not collinear with the remaining portion of the tip shroud 50 (i.e., the portion of the tip shroud 50 not including the nose portion 50), and the nose portion 72 is disposed at an angle 180 relative to the rotational axis 25 of the turbine 18. In the illustrated embodiment, the leading edge portion 54 of the tip shroud 50 generally refers to the portion of the tip shroud 50 upstream of the first rail 150 of the labyrinth seal 66.

As similarly discussed above, the leading edge 100 of the leading edge overhang 78 corresponds with a first corresponding portion 182 of the stationary structural component 23. In other words, the leading edge 100 of the leading edge overhang 78 and the first corresponding portion 182 each extend generally in the radial direction 34. Additionally, the first corresponding portion 182 of the stationary structural component 23 is disposed generally upstream from the leading edge 100 of the leading edge overhang 78, thereby creating the opening 104 of the clearance 64 between the tip shroud 50 and the stationary structural component 23.

As mentioned above, the nose portion 72 of the tip shroud 50 is generally oriented at the angle 180 relative to the rotational axis 25 of the turbine 18. For example, the angle 180 between the nose portion 72 of the tip shroud 50 and the rotational axis 25 of the turbine 18 may be approximately 0 to 75, 5 to 60, 10 to 45, 15 to 30, or 20 to 25 degrees. In the illustrated embodiment, the nose portion 72 of the tip shroud 50 corresponds to a second corresponding portion 184 of the stationary structural component 23, which also is generally oriented at the angle 180 relative to the rotational axis 25 of the turbine 18. Moreover, as similarly discussed above, the second corresponding portion 184 of the stationary structural component 23 is disposed generally upstream from the nose portion 72 of the tip shroud 50. Additionally, the nose portion 72 of the tip shroud 50 and the second corresponding portion 184 of the stationary structural component 23 are disposed generally opposite one another across the clearance 64 between the tip shroud 50 and the stationary structural component 23. In this manner, the nose portion 72 of the tip shroud 50 and the second corresponding portion 184 of the stationary structural component 23 are arranged in a generally parallel configuration. In other words, the contours (e.g., surfaces) of the nose portion 72 of the tip shroud 50 and the second corresponding portion 184 of the stationary structural component 23 are generally parallel with one another.

In the illustrated embodiment, the tip shroud 50 includes the first rail 150 of the labyrinth seal 66, which generally extends in the radial direction 34. As shown, the first rail 150 has the upstream surface 158, which is generally vertical. In other words, the upstream surface 158 of the first rail 150 extends generally in the radial direction 34. The upstream surface 158 of the first rail 150 corresponds to a third corresponding portion 186 of the stationary structural component 23. The third corresponding portion 186 also extends generally in the radial direction 34 (i.e., the third corresponding portion 186 is generally vertical). Additionally, as similarly discussed above, the third corresponding portion 186 of the stationary structural component 23 is disposed generally upstream from the upstream surface 158 of the first rail 150 of the labyrinth seal 66. In this manner, the upstream surface 158 of the rail 150 and the third corresponding portion 186 of the stationary structural component 23 are arranged in a generally parallel configuration relative to one another.

As shown, the leading edge 100 of the leading edge overhang 78, the nose portion 72 of the tip shroud 50, and the upstream surface 158 of the first rail 150 are arranged adjacent to one another and in consecutive order along the tip shroud 50 in the axial direction 32, with the leading edge 100 of the leading edge overhang 78 being the most upstream. Similarly, the portions of the stationary structural component 23 corresponding to each of the above-mentioned portions of the tip shroud 50 are arranged adjacent to one another and in consecutive order. Specifically, the first corresponding portion 182 of the stationary structural component 23, the second corresponding portion 184 of the stationary structural component 23, and the third corresponding portion 186 of the stationary structural component 23 are arranged in consecutive order along the stationary structural component 23 in the axial direction 32, with the first corresponding portion 182 of the stationary structural component 23 being the most upstream.

As described above, each portion of the leading edge portion 54 of the tip shroud 50 (e.g., the leading edge 100, nose portion 72, etc.) and the portion of the stationary structural component 23 with which it corresponds (e.g., the first corresponding portion 182, the second corresponding portion 184, etc.) have similar (e.g., generally parallel) contours and are disposed opposite one another across the clearance 64 between the tip shroud 50 and the stationary structural component 23. In certain embodiments, each portion of the leading edge portion 54 of the tip shroud 50 and the portion of the stationary structural component 23 with which it corresponds may be offset in the axial direction 32 the same or similar distance as every other portion of the leading edge portion 54 and the portion of the stationary structural component 23 with which they correspond. In this manner, the leading edge portion 54 of the tip shroud 50 and the corresponding portion 56 of the stationary structural component 23 are arranged in a generally parallel configuration. The generally parallel configuration of the leading edge portion 54 of the tip shroud 50 and the corresponding portion 56 of the stationary structural component 23 may help reduce leakage of the fluid flow 58 through the clearance 64 between the tip shroud 50 and the stationary structural component 23. For example, the generally parallel configuration between the leading edge portion 54 of the tip shroud 50 and the corresponding portion 56 of the stationary structural component 23 may provide a more tailored and/or reduced clearance 64 between the tip shroud 50 and the stationary structural component 23, resulting in reduction of leakage of the fluid flow 58 through the clearance 64.

Figure 6:
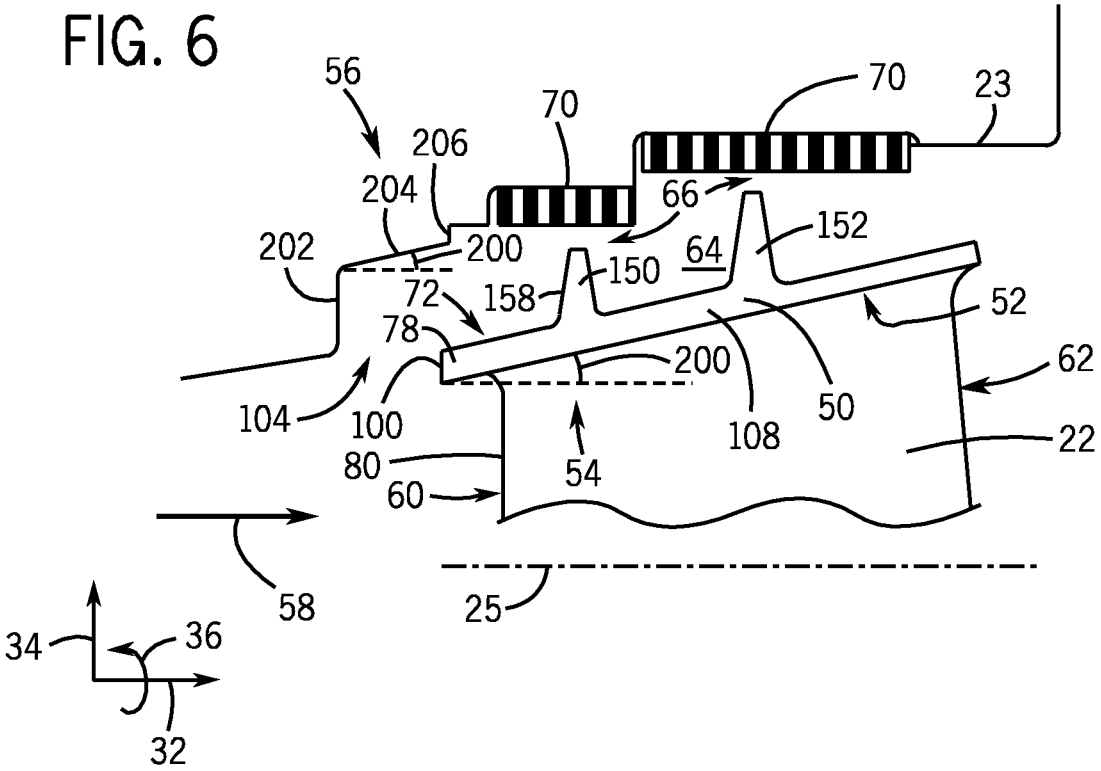
FIG. 6 is a partial side view of a turbomachine blade, illustrating an embodiment of a tip shroud and turbomachine stationary structural component having a generally parallel configuration, in accordance with embodiments of the present disclosure.

FIG. 6 is a partial side view of an embodiment of the turbine blade 22 and the stationary structural component 23, illustrating the tip shroud 50 disposed on the outer radial end 52 of the turbine blade 22, where the tip shroud 50 includes the labyrinth seal 66 having two rails 68 (e.g., the first rail 150 and the second rail 152) and two honeycomb inserts 70 (e.g., casing abradable surfaces), and the leading edge portion 54 of the tip shroud 50 and the corresponding portion 56 of the stationary structural component 23 have a generally parallel configuration. Additionally, in the illustrated embodiment, the nose portion 72 of the tip shroud 50 is collinear with the remaining portion of the tip shroud 50 (i.e., the portion of the tip shroud 50 not including the nose portion 72). Specifically, the entire tip shroud 50 is oriented at an angle 200 relative to the rotational axis 25 of the turbine 18. In the illustrated embodiment, the leading edge portion 54 of the tip shroud 50 generally refers to the portion of the tip shroud 50 upstream of the first rail 150 of the labyrinth seal 66.

As similarly discussed above, the leading edge 100 of the leading edge overhang 78 corresponds with a first corresponding portion 202 of the stationary structural component 23. Specifically, the leading edge 100 of the leading edge overhang 78 and the first corresponding portion 202 each extend generally in the radial direction 34. Additionally, the first corresponding portion 202 of the stationary structural component 23 is disposed generally upstream from the leading edge 100 of the leading edge overhang 78, thereby creating the opening 104 of the clearance 64 between the tip shroud 50 and the stationary structural component 23.

In the illustrated embodiment, the entire tip shroud 50, including the nose portion 72, is generally oriented at the angle 200 relative to the rotational axis 25 of the turbine 18. For example, the angle 200 between the tip shroud 50 and the rotational axis 25 of the turbine 18 may be approximately 0 to 75, 5 to 60, 10 to 45, 15 to 30, or 20 to 25 degrees. In the illustrated embodiment, the nose portion 72 of the tip shroud 50 corresponds to a second corresponding portion 204 of the stationary structural component 23, which also is generally oriented at the angle 200 relative to the rotational axis 25 of the turbine 18. Moreover, as similarly discussed above, the second corresponding portion 204 of the stationary structural component 23 is disposed generally upstream from the nose portion 72 of the tip shroud 50. Additionally, the nose portion 72 of the tip shroud 50 and the second corresponding portion 204 of the stationary structural component 23 are disposed generally opposite one another across the clearance 64 between the tip shroud 50 and the stationary structural component 23. In this manner, the nose portion 72 of the tip shroud 50 and the second corresponding portion 204 of the stationary structural component 23 are arranged in a generally parallel configuration. In other words, the contours (e.g., surfaces) of the nose portion 72 of the tip shroud 50 and the second corresponding portion 204 of the stationary structural component 23 are generally parallel with one another.

The tip shroud 50 includes the first rail 150 of the labyrinth seal 66, which generally extends in the radial direction 34. As shown, the first rail 150 has the upstream surface 158, which is generally vertical. In other words, the upstream surface 158 of the first rail 150 extends generally in the radial direction 34. The upstream surface 158 of the first rail 150 corresponds to a third corresponding portion 206 of the stationary structural component 23. The third corresponding portion 206 also extends generally in the radial direction 34 (i.e., the third corresponding portion 206 is generally vertical). Additionally, as similarly discussed above, the third corresponding portion 206 of the stationary structural component 23 is disposed generally upstream from the upstream surface 158 of the first rail 150 of the labyrinth seal 66. In this manner, the upstream surface 158 of the rail 150 and the third corresponding portion 206 of the stationary structural component 23 are arranged in a generally parallel configuration relative to one another.

As shown, the leading edge 100 of the leading edge overhang 78, the nose portion 72 of the tip shroud 50, and the upstream surface 158 of the first rail 150 are arranged adjacent to one another and in consecutive order along the tip shroud 50 in the axial direction 32, with the leading edge 100 of the leading edge overhang 78 being the most upstream.

Similarly, the portions of the stationary structural component 23 corresponding to each of the above-mentioned portions of the tip shroud 50 are arranged adjacent to one another and in consecutive order. Specifically, the first corresponding portion 202 of the stationary structural component 23, the second corresponding portion 204 of the stationary structural component 23, and the third corresponding portion 206 of the stationary structural component 23 are arranged in consecutive order along the stationary structural component 23 in the axial direction 32, with the first corresponding portion 202 of the stationary structural component 23 being the most upstream.

As described above, each portion of the leading edge portion 54 of the tip shroud 50 (e.g., the leading edge 100, nose portion 72, etc.) and the portion of the stationary structural component 23 with which it corresponds (e.g., the first corresponding portion 202, the second corresponding portion 204, etc.) have similar (e.g., generally parallel) contours and are disposed opposite one another across the clearance 64 between the tip shroud 50 and the stationary structural component 23. In certain embodiments, each portion of the leading edge portion 54 of the tip shroud 50 and the portion of the stationary structural component 23 with which it corresponds may be offset in the axial direction 32 the same or similar distance as every other portion of the leading edge portion 54 and the portion of the stationary structural component 23 with which they correspond. In this manner, the leading edge portion 54 of the tip shroud 50 and the corresponding portion 56 of the stationary structural component 23 are arranged in a generally parallel configuration. The generally parallel configuration of the leading edge portion 54 of the tip shroud 50 and the corresponding portion 56 of the stationary structural component 23 may help reduce leakage of the fluid flow 58 through the clearance 64 between the tip shroud 50 and the stationary structural component 23. Additionally, the generally parallel configuration may help reduce the generation of vortex flows within the clearance 64. For example, the generally parallel configuration between the leading edge portion 54 of the tip shroud 50 and the corresponding portion 56 of the stationary structural component 23 may provide a more tailored and/or reduced clearance 64 between the tip shroud 50 and the stationary structural component 23, resulting in increased blockage of the fluid flow 58 through the clearance 64.

As discussed in detail above, embodiments of the present disclosure include the tip shroud 50 of the turbine blade 22 arranged in a generally parallel configuration with the stationary structural component 23 of the turbine 18. Specifically, the leading edge portion 54 of the tip shroud 50 and the corresponding portion 56 of the stationary structural component 23 are arranged in a generally parallel configuration relative to one another. The generally parallel configuration between the leading edge portion 54 of the tip shroud 50 and the corresponding portion 56 of the stationary structural component 23 may reduce flow leakage through the clearance 64 between the tip shroud 50 and the stationary structural component 23. For example, the generally parallel configuration between the leading edge portion 54 of the tip shroud 50 and the corresponding portion 56 of the stationary structural component 23 may provide a more tailored clearance 64 between the tip shroud 50 and the stationary structural component 23, resulting in reduction of leakage of the fluid flow 58 through the clearance 64. In this manner, a turbomachine, such as the turbine 18, having the described generally parallel arrangement between the leading edge portion 54 of the tip shroud 50 and the corresponding portion 56 of the stationary structural component 23 may experience improved performance and efficiency.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A turbomachine, comprising:

a turbomachine blade, comprising:

a tip shroud, comprising a leading edge portion, wherein the leading edge portion has an upstream surface, a first surface downstream of the upstream surface, and a third surface downstream of the first surface, wherein the upstream surface and the first surface are directly adjacent to one another, and the first surface and the third surface are directly adjacent to one another; and a stationary structural component disposed about the turbomachine blade, and comprising a corresponding portion corresponding to the leading edge portion of the tip shroud, wherein the corresponding portion has a corresponding upstream surface, a second surface downstream of the corresponding upstream surface, and a fourth surface downstream of the second surface, wherein the upstream surface and the corresponding upstream surface have generally parallel contours that are generally perpendicular to an axis of rotation of the turbomachine, the first surface and the second surface have generally parallel contours that are generally parallel to the axis of rotation of the turbomachine, the third surface and the fourth surface have generally parallel contours that are disposed at an acute angle relative to the axis of rotation of the turbomachine, and the corresponding upstream surface and the second surface are continuous and directly adjacent to one another, and the second surface and the fourth surface are continuous and directly adjacent to one another, wherein the upstream surface is directly exposed to the corresponding upstream surface, the first surface is directly exposed to the second surface, and the third surface is directly exposed to the fourth surface.

2. The turbomachine of claim 1, wherein the leading edge portion comprises a nose portion extending from a leading edge of the turbomachine blade toward a trailing edge of the turbomachine blade, wherein the nose portion comprises a leading edge overhang extending from a leading edge of the turbomachine blade in an upstream direction.

3. The turbomachine of claim 1, wherein the stationary structural component comprises an abradable surface disposed downstream of the fourth surface.

4. The turbomachine of claim 3, wherein the tip shroud comprises a rail, the rail extends radially outward relative to the axis of rotation of the turbomachine, and the rail extends toward the abradable surface.

5. The turbomachine of claim 1, wherein the tip shroud comprises a rail disposed on the third surface, and the rail extends radially outward relative to the axis of rotation of the turbomachine.

6. The turbomachine of claim 2, wherein the tip shroud comprises a labyrinth seal having at least one rail.

7. The turbomachine of claim 2, wherein the turbomachine is a gas turbine or a steam turbine.

8. A system, comprising:

a turbine, comprising:

a turbine blade having a tip shroud comprising an upstream surface, a first surface downstream of the upstream surface, and a third surface downstream of the first surface, wherein the upstream surface and the first surface are directly adjacent to one another, and the first surface and the third surface are directly adjacent to one another; and a stationary structural component disposed about the turbine blade, wherein the stationary structural component comprises a corresponding upstream surface disposed opposite the upstream surface of the tip shroud, a second surface downstream of and directly adjacent to the corresponding upstream surface and disposed about the first surface of the tip shroud and a fourth surface downstream of and directly adjacent to the second surface and disposed about the third surface of the tip shroud, wherein the upstream surface and the corresponding upstream surface have generally parallel contours that are generally perpendicular to an axis of rotation of the turbomachine, the first surface and the second surface have generally parallel contours and are generally parallel to the axis of rotation of the turbine, the third surface and the fourth surface have generally parallel contours and are disposed at an acute angle relative to the axis of rotation of the turbine, wherein the upstream surface is directly exposed to the corresponding upstream surface, the first surface is directly exposed to the second surface, and the third surface is directly exposed to the fourth surface.

9. The system of claim 8, wherein the upstream surface and the first surface of the tip shroud comprise a leading edge overhang of the tip shroud.

10. The system of claim 9, wherein the leading edge overhang extends from a leading edge of the turbine blade in an upstream direction.

11. The system of claim 8, wherein the tip shroud comprises a rail disposed on the third surface, and the rail extends radially outward relative to the axis of rotation of the turbine.

12. The system of claim 8, wherein the stationary structural component comprises an abradable surface disposed downstream of the fourth surface.

13. The system of claim 12, wherein the tip shroud comprises a rail, the rail extends radially outward relative to the axis of rotation of the turbine, and the rail extends toward the abradable surface.

14. The system of claim 13, wherein the rail comprises a second upstream surface directly downstream from the third surface, the stationary structural component comprises a fifth surface directly downstream of the fourth surface, the second upstream surface is directly exposed to the fifth surface, and the upstream surface and the fifth surface have generally parallel contours.

15. The system of claim 14, wherein the upstream surface and the fifth surface are generally perpendicular to the axis of rotation of the turbine.

16. The system of claim 8, wherein the turbine is a gas turbine or a steam turbine.

17. A turbine, comprising:

a turbine blade, comprising:

a tip shroud comprising a first surface, wherein the first surface comprises a leading edge surface of a leading edge overhang extending in an upstream direction from a leading edge of the turbine blade, a nose portion, and an upstream surface of a rail of a labyrinth seal of the tip shroud, wherein the leading edge surface of the leading edge overhang is directly adjacent to the nose portion, and the nose portion is directly adjacent to the upstream surface of the rail; and a stationary structural component disposed about the turbine blade, wherein the stationary structural component comprises a second surface, wherein the second surface comprises a first corresponding portion disposed generally opposite the leading edge surface of the leading edge overhang, a second corresponding portion disposed generally opposite the nose portion, and a third corresponding portion disposed generally opposite the upstream surface of the rail, wherein the first corresponding portion is directly adjacent to the second corresponding portion, and the second corresponding portion is directly adjacent to the third corresponding portion, and wherein the first corresponding portion and the leading edge surface of the leading edge overhang have generally parallel contours and are generally perpendicular to an axis of rotation of the turbine, the second corresponding portion and the nose portion have generally parallel contours and are disposed at an acute angle relative to the axis of rotation of the turbine, and the third corresponding portion and the upstream surface of the rail have generally parallel contours and are generally perpendicular to the axis of rotation of the turbine, and wherein the leading edge surface of the leading edge overhang is directly exposed to the first corresponding portion, the nose portion is directly exposed to the second corresponding portion, and the upstream surface of the rail is directly exposed to the third corresponding portion.

18. The turbine of claim 17, wherein the turbine is a gas turbine or a steam turbine.

* * * * *